United States Patent [19]

Lewis

[11] 4,280,636

[45] Jul. 28, 1981

[54] CONTAINER COVER LOCKING ASSEMBLY

[75] Inventor: Duane H. Lewis, Claysville, Pa.

[73] Assignee: Continental Plastics, Inc., Washington, Pa.

[21] Appl. No.: 141,953

[22] Filed: Apr. 21, 1980

[51] Int. Cl.[3] ..... B65D 39/00

[52] U.S. Cl. ..... 220/307; 220/339; 222/565; 222/569

[58] Field of Search ..... 220/307, 337, 339; 222/153, 565, 566, 569, 480

[56] References Cited

U.S. PATENT DOCUMENTS

| | | | |
|---|---|---|---|
| 3,542,235 | 11/1970 | Hidding | 220/339 |
| 3,675,812 | 7/1972 | Foster | 222/565 |
| 3,907,156 | 9/1975 | Weatherhead | 220/307 |

*Primary Examiner*—George P. Hall

*Attorney, Agent, or Firm*—Parmelee, Miller, Welsh & Kratz

[57] ABSTRACT

A container cover locking assembly comprises a base member with a continuous peripheral skirt depending therefrom and a ridge parallel to yet spaced inwardly from the skirt along the underside of the base member. Tapered locking lips which depend downwardly from the ridge, extend along a substantial portion thereof and curve outwardly toward yet terminate skirt of the skirt. The locking assembly allows a simplified molding process for a container cover which is assembled with a container body of the type having curved mounting seat formed from the upper edge of the container walls.

7 Claims, 3 Drawing Figures

CONTAINER COVER LOCKING ASSEMBLY

BACKGROUND OF THE INVENTION

1. Field of the Invention

The invention is directed toward the locking means used to removably secure covers to containers.

2. Prior Art

The invention provides a locking means for a container cover used with a conventional container body of the type generally, but not exclusively, used for the packing of solid particulate matter such as powdered condiments. The container body is of the type having a cover mounting seat which may be formed from the inwardly curled upper edge of the body's side walls. Heretofor, it has been the practice to manufacture a container cover comprising a planar member with a continuous peripheral skirt and a locking member also depending from the underside of the planar member. The skirt and the locking member are in a parallel spaced relation. Additionally, a continuous bead is molded onto the side of the locking member facing the skirt. When the cover is assembled with a container body, the skirt depends over the outside edge of the container body wall and the locking member is in close association with the inwardly curled mounting seat. The continuous bead projects out from the locking member and extends below the curled mounting seat. The bead thereby inhibits upward motion of the cover relative to the container body. The continuous locking member is shown in U.S. Pat. Nos. 3,542,235; 3,370,757 and 3,675,812. The container is usually manufactured by an injection molding process which requires that the mold chamber of the locking member and bead be opened separately prior to the release of the cover from the mold. The complicated mold with movable chamber segments required to produce such a cover, carries with it heavy burdens in maintenance time and cost as well as a relatively slow production output.

It is therefore an object of this invention to provide a locking member in the form of a tapered lip for securing a container cover to a container body.

It is another object of this invention to provide a container cover which permits the use of a simplified mold design during manufacture.

It is still an object of this invention to provide a container cover which can be molded more quickly and less expensively due to the smooth tapered design of the locking member.

SUMMARY OF THE INVENTION

The invention consists of a locking assembly for container covers which are used in combination with container bodies of the type having a cover mounting seat which is formed from the inwardly curved upper edge of the body's side panels. The container consists of a base member, a sheet depending downwardly from the periphery of the base member and a continuous ridge spaced inwardly from, yet parallel with the skirt, along the underside of the base member. The skirt together with the ridge and the portion of the underside of the base there-inbetween form a mounting channel which rests on the container mounting seat. Resilient tapered locking lips depend from the ridge and curve outwardly toward yet terminate short of the depending skirt. The several locking lips extend laterally along the ridge for a substantial portion of the perimeter of the base member. The spaced relation of the locking lips relative to each other insures that the flexibility needed to assemble the cover onto the container body will be present in the locking assembly. The locking lips must also flex inwardly away from the skirt during the molding process.

The cover is integrally molded from a resinous material which imparts a sufficient resiliency to the locking lips which allows the lips to flex away from the skirt as required and then return to a normal position. Because of the design of the locking assembly, removal from the mold is simplified. The tapered locking lips allow the molded container cover to be pushed free of the mold without the usual repositioning of special mold portions as is necessary in the present state of the art.

DETAILED DESCRIPTION OF THE INVENTION

The locking assembly of the instant disclosure is described with a container cover having incorporated therein means for dispensing the contents of a container on which it is mounted. Such a dispensing configuration is typical of most containers presently in use. This is in no way meant to suggest that this is the only type of cover with which the locking assembly can be used. The container cover can comprise a solid base member and the container contents would be dispensed by removing the cover or, for example, through a dispensing means provided in the container body.

Figure 1:
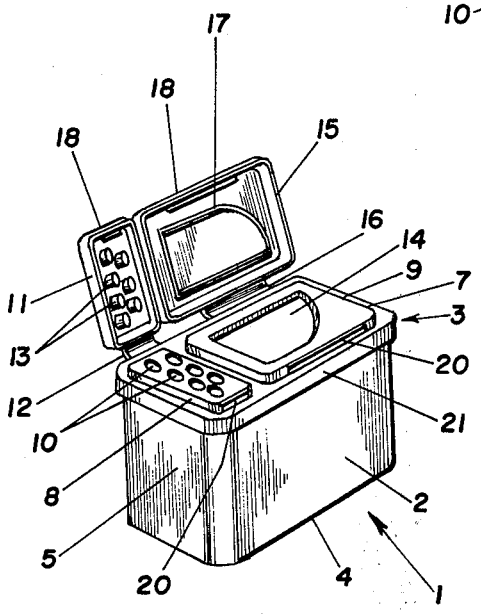
FIG. 1 is a perspective view of a container assembly in accordance with the invention.

Referring now to FIG. 1, a container assembly indicated generally by the numeral 1 is shown to include a container body 2 and a container cover 3 which incorporates the features of this invention. The container body 2 is conventional in design and manufacture with a bottom member 4 and a continuous side wall 5 which extends from the bottom member and terminates in an inwardly curved mounting seat 6, which is clearly visible in FIG. 2. It is upon this seat 6 that the cover 3 is detachably mounted and secured. The container cover 3 comprises a base member 7 with two decks thereon, a sifting deck 8 and a pouring or spooning deck 9. The sifting deck 8 has a plurality of orifices 10 which are cone like in shape, with the wider position of the cone at the top of the deck 8. A sifting deck cap 11 is attached to the cover base by means of flexible member 12. Sealing cones 13 protrude from the inside of the shaker deck cap and are aligned so as to mate with the orifices 10 thus providing a sealing means for the shaker orifices. A spooning deck 9 is provided with an opening 14 which is of sufficient size to permit the passage of a spoon or similar measuring device into the container assembly. A deck cap 15 is also provided for the spooning deck and is attached to the base member 7 by a flexible member 16. On the inside face of the cap 15 is a continuous protruding flange 17 which mates with the perimeter of opening 14 and acts as a sealing means for said opening.

Figure 2:
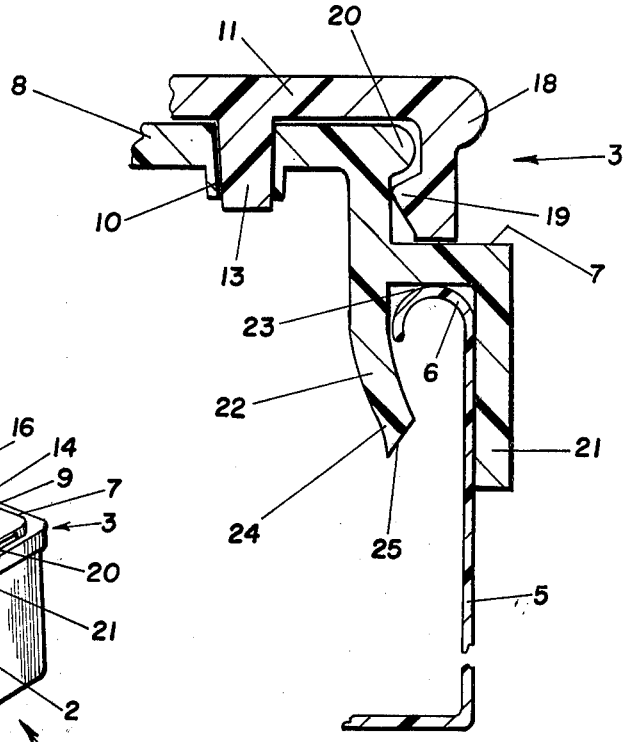
FIG. 2 is a partial, vertical, sectional view through a container assembly incorporating the invention, taken along the line II—II in FIG. 3.

Turning now to FIG. 2, the relationship of the sealing cones 13 and the sifting orifices 10 when the deck cap 11 is closed over the deck 8 is clearly shown. The deck cap 11 is provided with offset beads 18 and 19. Bead 18 serves as a lifting point for urging the deck cap free of the sifting orifices. The inner bead 19 interlocks with a deck bead 20 and secures the deck cap 11 firmly onto the sifting deck 8. The cap 15 which closes the opening 14 in the spooning deck 9 is molded with the same bead configuration in order to removably fasten the cap 15 in a closed position over spooning deck 9.

The container cover is provided with locking means by which it can be removably mounted and secured to a container body. At the periphery of the container cover base member 7 is a downwardly depending continuous skirt 21 which overlaps the side wall 5 of the container body. Inwardly spaced in a parallel relation with the skirt 21 there is a continuous ridge 22 which together with the skirt 21 and the underside of the base 7 between the skirt and the ridge form a mounting channel which is indicated by the numeral 23. The mounting channel 23 is generally contiguous with the mounting seat 6 of the container body when the cover and container are assembled as shown in FIG. 1. The mounting channel provides a seal which inhibits entry of foreign matter into the container's contents by way of the mounting assembly area. The cover is removably secured to the container body by means of locking lips 24 which depend from the ridge 22. The locking lips 24 curve outwardly toward yet terminate short of the depending skirt 21. A bevelled edge 24 is formed at the terminal portion of each locking lip 24 in order to facilitate the mounting of the cover onto a container body. The locking lips extend laterally along ridge 22 for a substantial portion of the edge of the base member 7. When the cover is correctly mounted onto a container body, the locking lips 24 curve around the lower portion of the mounting seat 6 and urge the mounting channel 23 down against the upper surface of the mounting seat. Preferably, the locking lips 24 extend downwardly below the terminal edge of the inwardly curved mounting seat as shown in FIG. 2.

Figure 3:
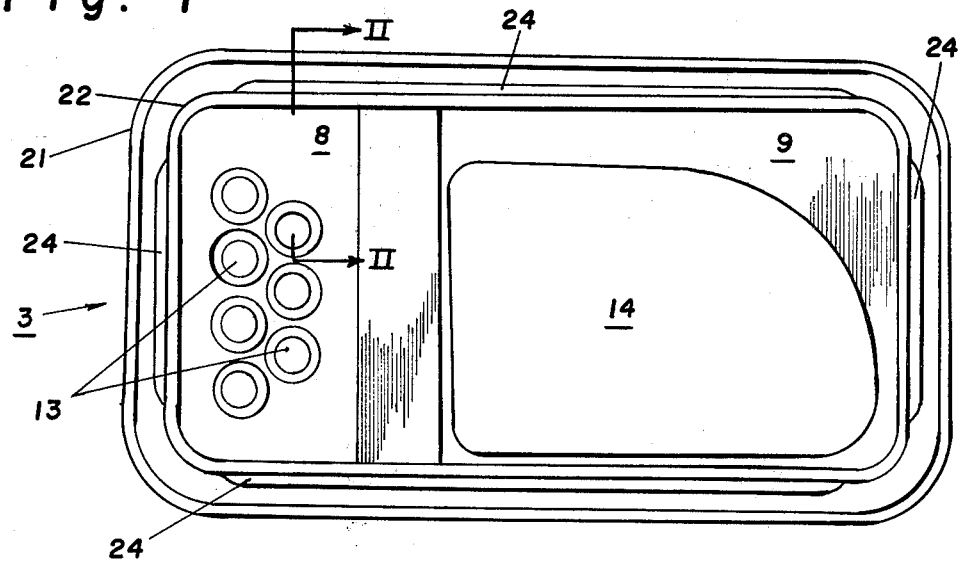
FIG. 3 is a plan view of the underside of the container cover shown in FIG. 3.

In one embodiment, as shown in FIG. 3, the container cover base member 7 is rectangular and the locking lips 24 extend along a substantial portion of each edge of the base member. Unlike the continuous skirt and ridge, the locking lips do not intersect at the corners of the base member. As a result, there is an open area or notch between perpendicularly situated locking lips. The notch allows the lips to flex away from the skirt toward the center of the container cover whereby the container cover can be mounted onto or removed from a container body. The bevelled terminal portion 25 of the locking lip 24 is useful during the container cover mounting process. When the cover is aligned over the container body for mounting, the locking lips 24, in their normally closed position would impede the mounting by possibly closing the channel 23. The bevelled edge 24 rides down over the inside edge of the curled mounting seat 6 and urges the lips away from the skirt. Once the bevelled edge is beyond the inside edge of the mounting seat, the lips return to their normally closed position and bias the cover down against the container body.

A significant advantage of the locking lip design is the simplication of the mold required to manufacture the container cover. Because the locking lips 24 are flexible and have smooth sides, the cover can be simply pushed free of the mold. The lip rides upwardly over the portion of the mold which defines the mounting channel 23. In a conventionally designed container cover, the mold would be of multiple sections which would have to be disengaged from the locking bead before the cover could be released from the mold.

Because of the simplification of the mold used in the manufacture of a container cover incorporating the features of this invention, the distance which the peripheral skirt 21 depends downwardly from the base member 7 relative to the locking lips is variable. However in the preferred embodiment, the skirt extends below the locking lips. This configuration allows the container cover to be properly aligned with the container body mounting seat before any movement of the locking lips away from the skirt takes place.

While the embodiment described herein has been directed toward a rectangular container cover, it is possible to incorporate the securing means of the instant invention into container covers of various shapes. For example, a circular container cover could be provided with a plurality of arcual locking lips which cooperate with the mounting seat of a circularly shaped container body.

The improved container cover of this disclosure provides a locking means for securing a container cover to a container body which, because of its design, allows the use of a simplified mold during manufacture.

I claim:

1. A locking assembly for a container cover used with a container body of the type having a cover seat formed from the inwardly curved upper edges of the container body's side panels, comprising:

a base member;

a continuous peripheral skirt depending downwardly from said base member;

a ridge depending downwardly from said base member, said ridge being spaced inwardly from and parallel with said skirt and forming together with said skirt and the portion of said base member between said skirt and said ridge a mounting channel which engages said container mounting seat; and several tapered locking lips depending from said ridge and curving outwardly toward yet terminating short of said skirt for urging said container cover down against said mounting channel.

2. The device of claim 1 wherein the container cover is integrally molded from a resinous material.

3. The container cover of claim 1 wherein the peripheral skirt depends downwardly below the terminal portion of the locking lip.

4. The locking means of claim 1 wherein the tapered locking lip terminates in a bevelled edge which urges said lip away from the skirt during the installation of the cover onto the container body mounting seat.

5. The device of claims 1 or 4 wherein the container cover is rectangular and the locking lips laterally extend for a substantial portion along each edge of said cover.

6. The device of claims 1 or 4 wherein the container cover is circular and includes a plurality of arcual locking lips.

7. The device of claims 1 or 4 wherein the tapered locking lips extend downwardly below the terminal edge of the cover seat.

* * * * *